US011662184B2

(12) United States Patent
Rushforth

(10) Patent No.: US 11,662,184 B2
(45) Date of Patent: May 30, 2023

(54) DEVICE AND METHOD FOR MINE DISPOSAL

(71) Applicant: The Secretary of State for Defence, Salisbury (GB)

(72) Inventor: Peter Richard Rushforth, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 49 days.

(21) Appl. No.: 17/427,901

(22) PCT Filed: Feb. 21, 2020

(86) PCT No.: PCT/GB2020/000019
§ 371 (c)(1),
(2) Date: Aug. 2, 2021

(87) PCT Pub. No.: WO2020/174206
PCT Pub. Date: Sep. 3, 2020

(65) Prior Publication Data

US 2022/0120535 A1 Apr. 21, 2022

(30) Foreign Application Priority Data

Feb. 25, 2019 (GB) ..... 1902624

(51) Int. Cl.
*F41H 11/12* (2011.01)
*F42B 12/36* (2006.01)

(52) U.S. Cl.
CPC ..... *F41H 11/12* (2013.01); *F42B 12/36* (2013.01)

(58) Field of Classification Search
CPC ..... F41H 11/12; F41B 12/36
(Continued)

(56) References Cited

U.S. PATENT DOCUMENTS 5,323,726 A * 6/1994 Olsson ..... B63G 7/06 114/221 R
6,298,763 B1 10/2001 Greenfield et al.
(Continued)

FOREIGN PATENT DOCUMENTS

DE 3626434 A1 2/1988
DE 10358816 A1 7/2005
(Continued)

OTHER PUBLICATIONS

International Patent Application No. PCT/GB2020/000019, International Search Report and Written Opinion, dated May 12, 2020.
(Continued)

*Primary Examiner* — Samir Abdosh
(74) *Attorney, Agent, or Firm* — Kilpatrick Townsend & Stockton LLP

(57) ABSTRACT

A projectile for piercing a casing of a mine containing an explosive material. The projectile includes a projectile body having a nose portion and a tail portion and a longitudinal axis, a switch, and electrodes separated such that in use an electrical discharge can flow between them through an explosive material contained within a mine, or to initiate an energetic material provided between the electrodes to detonate an explosive material contained within a mine. Also provided is a method of mine disposal.

21 Claims, 7 Drawing Sheets

(58) Field of Classification Search
USPC ..... 89/1.13
See application file for complete search history.

(56) References Cited

U.S. PATENT DOCUMENTS 6,748,842 B1 6/2004 Guirguis
7,051,636 B1 * 5/2006 Snow ..... F41H 13/0075 250/341.1
7,775,146 B1 * 8/2010 Bitar ..... F41H 11/32 89/1.13
8,430,011 B1 * 4/2013 Foley ..... F42D 5/04 89/1.13
8,561,515 B1 * 10/2013 Bitar ..... F41H 11/32 89/1.13
8,677,876 B2 * 3/2014 Diaz ..... F41H 11/13 89/1.13
8,683,907 B1 * 4/2014 Howe ..... F41H 11/12 89/1.13
8,904,937 B2 * 12/2014 Mangolds ..... F42B 3/00 102/331
10,989,511 B2 * 4/2021 Schmit ..... F41B 9/0087
2004/0200341 A1 * 10/2004 Walters ..... F41H 11/32 89/1.13
2008/0156219 A1 * 7/2008 Voss ..... F41H 13/0025 102/402
2015/0241179 A1 * 8/2015 Patel ..... F42B 3/10 89/1.13

FOREIGN PATENT DOCUMENTS

GB 2326132 A 12/1998
JP 2007003100 A 1/2007
RU 2584048 C1 5/2016

OTHER PUBLICATIONS

United Kingdom Patent Application No. 2002335.4, Combined Search and Examination Report, dated Jul. 24, 2020.
United Kingdom Patent Application No. 1902624.4, Search Report, dated Sep. 9, 2019.
International Patent Application No. PCT/GB2020/000019, International Preliminary Reporton Patentability, dated Sep. 2, 2021.

* cited by examiner

DEVICE AND METHOD FOR MINE DISPOSAL

TECHNICAL FIELD OF THE INVENTION

The invention relates to the field of projectiles and in particular to projectiles for mine disposal and to methods of using said projectiles.

BACKGROUND TO THE INVENTION

Mines can have a devastating impact on personnel, platforms, vehicles and other equipment. Therefore, in areas were mines have been deployed, it is important that they can be disposed of effectively so as to provide a safe path or area for personnel and vehicles to enter and operate.

Mines have been deployed in a wide variety of locations including surface and buried land mines as well as naval mines located in the ocean and other bodies of water. Naval mines in particular can be challenging to dispose of due to the added complexities of operating at sea.

Mapping or marking mined areas may be sufficient for some applications where it is possible to avoid the affected areas altogether. However, such measures may be insufficient where it is necessary for personnel or expensive equipment to enter the mined region. Where access to the mined area is desirable or necessary it is known that an explosive device may be used to detonate the mine. However, this method may require the storage, transit and deployment of an explosive device which may require expertise to operate and which may pose an additional safety risk and cost.

Therefore, it is an aim of the present invention to provide an alternative means for mine disposal.

SUMMARY OF THE INVENTION

According to a first aspect of the invention there is provided a projectile for piercing a casing of a mine containing an explosive material;

the projectile comprising a projectile body having a nose portion and a tail portion wherein a longitudinal axis extends between the nose portion and the tail portion, the projectile body comprising a switch, and a first electrode and a second electrode;

wherein the switch is configured to control the closure of a circuit connecting the first electrode and the second electrode to a source of electrical energy; and wherein the first electrode and the second electrode are separated by a separation distance such that in use an electrical discharge can flow between the first electrode and the second electrode, either through an explosive material contained within a mine, or through a material comprised between the electrodes or which is introduced between the electrodes in use, so as to cause the material to release energy so as to detonate an explosive material contained within a mine.

According to a second aspect of the invention there is provided, a method of mine disposal, the method comprising the steps of: (i) providing a projectile according to the first aspect of the invention; (ii) launching the projectile towards a mine; (iii) piercing the casing of the mine with the projectile; and (iii) applying a voltage between the first electrode and the second electrode of the projectile so as to cause an electrical discharge to flow between the first electrode and the second electrode either through an explosive material contained within a mine, or through a material comprised between the electrodes or which is introduced between the electrodes in use, so as to cause the material to release energy so as to detonate an explosive material contained within a mine.

The material comprised between the electrodes, or which may be introduced in use, is one that explodes or combusts when electricity is discharged through it. Examples include aluminium foil or salt water. Clearly a suitable amount should be used such that the electrical discharge to be delivered to it, will cause its temperature to rise appropriately so that it delivers an appropriately high amount of energy for initiating explosion of the explosive material contained within the mine.

Optionally, the nose portion is provided with a water ingress path arranged such that in use underwater, water can ingress to a location between the first and second electrodes, such that in use an electrical discharge can flow between the first electrode and the second electrode, through the water between the electrodes, to initiate the energetic material, to detonate an explosive material contained within a mine. This will be most effective when the water used is salt water. The salt water does not need to be provided by the user if the projectile is being used in a salt water environment, since the projectile will be immersed in salt water by virtue of its use, so the leak path enables an amount (i.e. controlled by the space available between the electrodes) quantity of the environmentally abundant salt water to ingress between the electrodes, and the amount is controlled such that the electrical discharge will cause that quantity of water to explode.

The first and second electrodes are separated by a separation distance such that, in use, once the projectile has pierced through the casing of the mine, and the electrodes are in contact with the explosive material, applying a suitable voltage and current into the electrodes causes an electrical discharge to flow between the two electrodes and through the explosive material (or energetic material if comprised in the projectile). For instance, in use, an electrical discharge may flow between the first electrode and the second electrode through an explosive material contained within a mine so as to initiate an explosive reaction. The electrical discharge may be caused by the electrical breakdown of the explosive material located in the region of the applied electrical field created between the two electrodes, resulting in the flow of plasma formed from ionised particles of the explosive material. Electrical breakdown of the explosive material may occur when the voltage applied between the electrodes causes (e.g. forms) an electric field in the explosive material which exceeds the breakdown voltage of the explosive material. The electrical discharge may overcome the Figure of Sensitivity of the explosive to detonate the mine. The electrical discharge may flow through the explosive material contained within the detonator and/or the explosive material of the main charge. The projectile is therefore capable of initiating, and thereby disposing of, a mine without the use of additional explosives. Therefore, projectile is particularly suitable as a mine disposal projectile.

In more difficult to access areas it can be particularly disadvantageous to transport and deploy explosive materials typically used during mine disposal. Therefore, the invention may be particularly advantageous for the disposal of mines located in terrain which may be difficult to access, for example, in the case of naval mines or underwater mines.

The projectile may be arranged such that, in use, it sufficiently pierces the casing of the mine such that the first electrode and the second electrode at least partially enter the body of the mine and the explosive material contained therein. Optionally, the projectile may be arranged such that one of, or advantageously both of, the first and the second electrodes fully enter the body of the mine.

The projectile body comprises a nose portion and a tail portion. The nose portion and the tail portion may be formed as a single component. Alternatively, the nose portion and the tail portion may be formed as separate components which are attached by any suitable attachment means. For example, the nose portion and the tail portion may be attached by, welding, adhesive, bolts or any combination thereof.

The length of the projectile body may be between 5 cm and 50 cm, more particularly between 10 cm and 30 cm in length. Optionally, the diameter of the projectile body may be between 1 cm and 10 cm, more particularly between 2 cm and 5 cm.

The projectile body may be optimised for piercing a particular material and/or thickness of mine casing. For example, the projectile body may be optimised to pierce a mine casing formed substantially from metal, plastic, glass fibre reinforced plastic or any combination thereof. Advantageously, the projectile may be optimised to pierce a mine casing having a thickness of between 2 mm and 60 mm, or more particularly between 5 mm and 30 mm, or even more particularly between 5 mm and 10 mm.

The shape of the nose portion and/or the tail portion, may be configured to improve the penetration of the projectile into the mine casing. For example, the projectile nose portion may be substantially flat, substantially stepped, substantially conical or substantially hemispherical in shape. Optionally, the surface of the nose portion and/or the tail portion may comprise a surface texture to improve penetration of the projectile through the mine casing, such as, one or more grooves, fins, blades or threads.

The nose portion may be formed from any material suitable for piercing a mine casing. For example, the nose portion may be at least partially formed from Tungsten or Hardened Steel or metal alloys.

Advantageously, the nose portion may comprise a detachable (E.g. or sacrificial) casing. The detachable casing may be optimised to reduce the coefficient of drag associated with passage of the projectile through a fluid, for example, through seawater. This may be particularly advantageous, for example, in the disposal of an underwater mine where it may be necessary for the projectile to travel some distance through a body of water before reaching a mine.

The detachable casing may be arranged to be detachable responsive to an impact between the projectile and a mine casing. For instance, the detachable casing may be frangible. Optionally the detachable casing may be arranged such that in use it breaks away upon impact of the projectile with the mine casing. Alternatively, the casing may be configured to detach in response to a trigger means, such as, a timer, a proximity sensor, a remotely operated switch, or any combination thereof.

The detachable casing may be formed from any suitable material, for example, plastic, glass reinforced plastic, metal, metal foil, ceramic, or any combination thereof.

The explosive material may be the main charge explosive and/or it may be the explosive material contained within the booster or detonator of the mine. The explosive material may be any suitable explosive material capable of detonation in response to an electrical discharge. For example, the explosive material may be a High Explosive, such as, TNT, RDX or PETN.

The first electrode and/or the second electrode may be positioned in whole or in part on the surface of the projectile body. The first and/or second electrode may be shaped to encourage contact of the explosive material with both electrodes (preferably complete contact covering all of at least one of the electrodes, preferably covering all of both electrodes) so as to ensure the current path within the explosive material (as opposed to air or other substances in the vicinity of the explosive material). In particular, positioning of at least one of the electrodes at least partially on the surface may enable the electrode(s) to more readily come into contact with the explosive material after the projectile penetrates the mine casing.

One of the first electrode or the second electrode may extend in whole or in part into the projectile body. More preferably, both of the first and the second electrodes may extend in whole or part of into the projectile body. By extending in whole or in part into the projectile body the electrode(s) may be at least partially protected by the projectile body during the penetration of the mine casing.

The portion of the first electrode which extends into the projectile body may be separated from the portion of the second electrode which extends into the projectile body by an insulator. The insulator may be any material, or composite material, suitable for electrically insulating the first and second electrodes, for example, plastic, glass, ceramic, wax, oil or any combination thereof.

Advantageously, the nose portion may comprise whole or part of one or both of the first electrode and the second electrode. For example, both of the electrodes may at least partially extend into the nose portion of the projectile. This arrangement is particularly advantageous where it is preferable that only the nose portion of the projectile body extends into the mine after piercing.

The nose portion may be formed from whole or part of one or both of the electrodes. Said electrode(s) may thereby readily come into contact with the explosive material upon piercing of the mine casing.

One or both of the first and the second electrodes may be arranged such that the electrode(s) is/are projectable away from the projectile body. For example, one or both of the first and the second electrodes may be arranged such that the electrode(s) is/are projected away from the projectile body responsive to the piercing a mine casing. Optionally, one or both of the first and the second electrodes may be located at or beneath the surface of the projectile body and arranged such that the electrode(s) is/are projected away from the projectile body responsive to the piercing a mine casing. This arrangement may protect the electrode(s) from damage during impact with the mine and/or penetration of the mine casing. By projecting the electrode(s) away from the projectile body, such that they extend away from the projectile body and into the explosive, this may ensure the electrodes become further embedded within the explosive material with the advantage of ensuring the current path through the target explosive but may increase the separation distance between the electrodes. This may increase the distance that the electrical discharge travels through the explosive material, which would require increased voltage to exceed the minimum breakdown voltage required for the initiation of the explosive material in question.

The electrode(s) may be projected away from the projectile body by any suitable means, for example, an actuator, such as, a mechanical, pneumatic or hydraulic actuator. One or both of the electrodes may be deformable, such that, in use, the impact of the projectile with the mine casing causes one or both of the electrodes to contact a portion of the projectile body resulting in deformation of the electrode(s) such that the electrode(s) extend away from the projectile body.

The first electrode and the second electrode may be a transmission line such as planar or coaxially arranged about the longitudinal axis. This arrangement may allow for a particularly compact arrangement of the projectile. For instance, one of the electrodes may form a central core electrode about which a second tubular electrode is arranged. Preferably, there may be a tubular insulating material arranged between the coaxially arranged electrodes. Each of the coaxially arranged electrodes may extend along whole or part of the longitudinal axis of the projectile body. For example, the one of the electrodes may form a central core electrode, wherein a portion of the central electrode forms the nose portion of the projectile body. Advantageously one, or both, of the tubular electrodes may form a portion of the outer surface of the projectile body.

Advantageously, the first electrode and the second electrode may be separated along the longitudinal axis of the projectile by the separation distance. For example, the one of the electrodes may be located in the nose portion and the other electrode may be located in the tail portion.

The electrodes may be formed of any suitable conductive material, for example, the electrodes may be formed from copper, tungsten, steel, titanium, brass, silver, chromium, chromium alloy, or other metal alloys, or platinum, preferably chromium or chromium alloy.

The first electrode and the second electrode are arranged so as to be connectable to a source of electrical energy. One or both of the electrode(s) may be arranged so as to be permanently attachable to the source of electrical energy, for example, by welding, (e.g. threaded) bolts or other suitable means. Advantageously, one or both of the electrodes may be arranged so as to be temporarily attachable to the source of electrical energy. One or both of the electrodes may comprise an electrical connector for attaching the electrode (s) to a source of electrical energy. For example, the electrical connector may form one portion of an inter-engaging fixing. The other portion of the inter-engaging fixing may be associated with the source of electrical energy. Such inter-engaging fixings may be, for example, plug and socket connectors or ring/spade terminals. The electrical connector may comprise an integral portion of the electrode or may be a separate component attached to the electrode(s).

The application of the voltage may be controlled such that it occurs when the electrodes are embedded within the explosive material of the mine. Advantageously, the projectile may comprise a switch configured to connect the first electrode and the second electrode to a source of electrical energy. The switch may be used to control the closure of a circuit connecting the first electrode and the second electrode to a source of electrical energy. Advantageously, the switch may be arranged so as to be remotely controlled. The switch may be a thin insulating layer of metal oxide that activates when the electrical breakdown of the thin layer is reached. The switch may comprise a timer. The timer may be configured to control the timing of the operation of the switch. The switch typically connects one electrode in a controlled fashion (i.e. selectively connects the electrode to the source of electrical energy), and may be arranged to connect other electrode continuously (or alternatively it may connect both electrodes in a controlled fashion). Whilst the source of electrical energy is preferably comprised as part of the projectile (e.g. as part of or within the tail of the projectile), it may alternatively be separate or may be part of a launcher for the projectile, however in the latter cases, the user should connect the projectile to the source of electrical energy via cabling (E.g. two insulated wires, typically bound as a single cable).

Advantageously, the switch may comprise a sensor configured to sense the piercing of a mine casing by the projectile. Thereby, the switch may be operated upon sensing the piercing of a mine casing by the projectile The switch may comprise a first switch element and a second switch element, wherein the first switch element and the second switch element are separated along the longitudinal axis by a switch distance, and wherein the switch is compressible along the longitudinal axis such that in use impact of the projectile body with a mine casing causes relative movement between the first element and the second element along the longitudinal axis such that the switch distance is reduced causing the switch to be triggered. For example, the first switch element and the second switch element may be the first and second plates of a spark gap. The spark gap may be compressible along the longitudinal axis such that in use impact of the projectile with the casing of a mine causes the first plate and the second plate to move towards one other along the longitudinal axis. Thereby, the distance between the two spark gap plates may be reduced sufficiently that a current may flow between them in the form of a discharge.

Advantageously, the projectile may comprise a retaining means for retaining the projectile partially within the casing of a mine. For instance, it may be desirable to control the proportion of the projectile body which penetrates the mine casing. This may provide a convenient means for ensuring that the projectile does not exit the mine prior to detonation. Advantageously, the retaining means may form part of the tail portion of the projectile body.

Optionally, the projectile may be arranged such that in use only the nose portion of the projectile body penetrates into the mine casing after piercing. For instance, the tail portion may comprise components which, by remaining external to the mine, may be protected from impact damage.

The retaining means may comprise a flange projecting from the projectile body. For example, the flange may comprise an external rim or collar projecting from the projectile body.

Advantageously, the projectile may further comprise a source of electrical energy. Advantageously, the source of electrical energy may be integral to the projectile body. Alternatively, source of electrical energy may be separate from the projectile body. The source of electrical energy may be electrically connected to the projectile by wires. For example, the wires may be between 1 meter and 50 meters in length.

The source of electrical energy may be any suitable energy source. For example, the source of energy may comprise a capacitor or battery.

Optionally, the source of electrical energy may comprise a magnet arranged to move through a coil of wire where the impact causes the magnet to travel through the wire inducing a current in it that may be a high voltage.

Advantageously, the source of electrical energy may comprise a piezoelectric material. For instance, the piezoelectric material may be arranged such that in use when the projectile impacts with a mine the piezoelectric material undergoes mechanical stress resulting in the generation of electrical energy. For example, the piezoelectric material may be a piezoelectric crystal.

The source of electrical energy may comprise a capacitor. The capacitor may be arranged to charge or discharge responsive to the penetration of a mine casing by the projectile and may be remotely discharged by an external stimulus such as a detectable oscillating wave of a specific frequency or set of frequencies in the local environment that is received as a command to charge the capacitor or activate a switch to discharge the capacitor. If a remote trigger is used, the projectile needs to incorporate a receiver, sensitive to a predetermined signal (acoustic or electric/electronic) able to detect the signal and trigger the electrical discharge. Additionally or alternatively a time delay circuit may be incorporated to provide control over the timing of the electrical discharge.

The energy source may be optimised to supply a voltage across the separation distance between the electrodes sufficient to cause an electrical breakdown for a particular explosive material or range of explosive materials. For example, the energy source may be arranged to supply between 1,000 to 30,000 volts per mm across the separation distance between the electrodes.

Optionally, the projectile may comprise a means for charging the energy source. For example, the means for charging the energy source may comprise an integral battery with a high voltage charging circuit.

Advantageously, the separation distance between the electrodes may be in the range of 0.1 mm to 5 cm, more advantageously in the range of 0.1 mm to 5 mm.

The projectile body may comprise a damping means for damping internal oscillations resulting from the impact with a mine. For example, the damping means may be arranged to damp internal oscillations of one or more of the integral power source, electronic circuitry, the switch, the first electrode, the second electrode, and the means for charging the energy source, or any combination thereof. For instance, the damping means may comprise a hydraulic damper or a mechanical damper. Optionally, the damping means may comprise a spring. Advantageously, the damping means may comprise, for example, a cavity comprising a compressible fluid such as air or a liquid such as oil or silicone. Advantageously, the damping means may comprise a cavity comprising a wax or highly viscous material. The material may be optimised to change state in use from a solid to a liquid in response to the shock or heating of the projectile body upon impact (for instance the material may be granular/pelleted rather than liquid prior to use). For instance, the projectile body may comprise one or more through holes through which the wax may flow out of the projectile body when in a liquid state.

The electrodes may be treated to form a thin layer of oxide that with a high voltage stress structure, such as a protrusion from a flat surface that may be pointed or spherical or any shape with an asymmetry that encourages an electric field gradient over its cross section, can act as a high voltage breakdown switch with an operating switch voltage proportional to the thickness, homogeneity and smoothness of the oxide layer. This may form part of a triggering system whereby a capacitor supplying the switch may have an operating voltage that exceeds the switch voltage, which as the capacitor becomes charged reaches the switch voltage where the charge crosses the switch and forms a current path through the medium between the electrodes, which may be a high explosive material that initiates by the electrical current path passing through it or may be a material that exhibits energetic properties under sufficient pulse power conditions, such as aluminium foils or wires with oxidising fuel such as water and plastic or commercially available non-explosive energetics such as METAFEX. Preferably the energetic material is not an explosive, but is a material that explodes when sufficient electrical discharge is passed through it (an example being aluminium foil). This has the advantage of increasing reliability without worsening handling safety.

The complete disposal of the mine may be achieved by direct or in-direct initiation of electrical discharge such as pulse power or high voltage alternating current. As direct initiation by method of pulse power may require control of the contact of target high explosive material between the electrodes to ensure a current path through the material, in-direct initiation may make use of a non-explosive energetic material(s) or compound(s) such as metal foil or wires and compounds thereof that may initiate the target high explosive within the mine through sympathetic explosion due to the initiation of the non-explosive energetic material which may provide an advantage in reliability, cost of manufacture or electrical energy storage requirements within the dart.

The nose portion may be shaped in a way as to permit or encourage the flow of high explosive material onto the electrodes during or after penetration of the nose into the mine case. This may advantageously provide a means for ensuring the current path of the high voltage discharge passes through the explosive material.

The projectile may be powered for penetrating means without propellant and instead by high pressure gas and may be powered using differential relative pressures to generate the force needed to penetrate the mine case by positioning the relative pressure chamber(s) about the projectiles longitudinal axis in a way that allows the free movement of the projectile forward on release of the high pressure gas. The gas may be stored in a chamber that is attachable or unattached to the projectile body either in-front or behind the nose and tail portion of the projectile and may be pierced to release the pressure or may be controlled by a valve mechanism. The pressure(s) may be held in potential until a remote means of activation such a remotely operated switch or triggering mechanism.

One of the penetrating electrodes may be a high temperature metal, such as Tungsten or alloys of the same, which may be heated by the energy source to exceed the FOI of heat for the explosive material within the mine. The high temperature metal may be heated by an alternating current supplied by the energy source.

The projectile may electrically couple to the target system case to deliver a pulse power discharge or high voltage signal to the electronics that may be connected to the target system case for the purpose of electrical grounding of the target system electronics. This may damage the target system electronics rendering it in-operable or reduce its function or cause mission abort.

The projectile may discharge within the case to induce electrical currents within the mine electronics by means of a pulse power discharge or high voltage signal that may influence or damage the target system electronics rendering it in-operable or reduce its function or cause mission abort.

The tail portion generally has a larger cross section than the nose portion with respect to the longitudinal axis, being at least double that of the nose portion (preferably at least four times greater, preferably at least 8 times greater). This enables the projectile to project the electrodes into a mine casing, and to have a suitably powerful (i.e. large) source of electrical energy within it, but without requiring such a high projectile velocity as would be required to project the source of electrical energy into the mine casing. This also reduces the required structural strength of the projectile body, and amount of propellant required to accelerate it. Generally the nose and tail portions are separated by a sleeve, which may advantageously be generally conical, such as to reduce the sudden-ness of deceleration when the tail portion impacts the mine casing.

BRIEF DESCRIPTION OF THE DRAWINGS

The invention will now be described, purely by way of example, with reference to the accompanying drawings, in which.

The drawings are for illustrative purposes only and are not to scale.

DETAILED DESCRIPTION

Figure 1A:
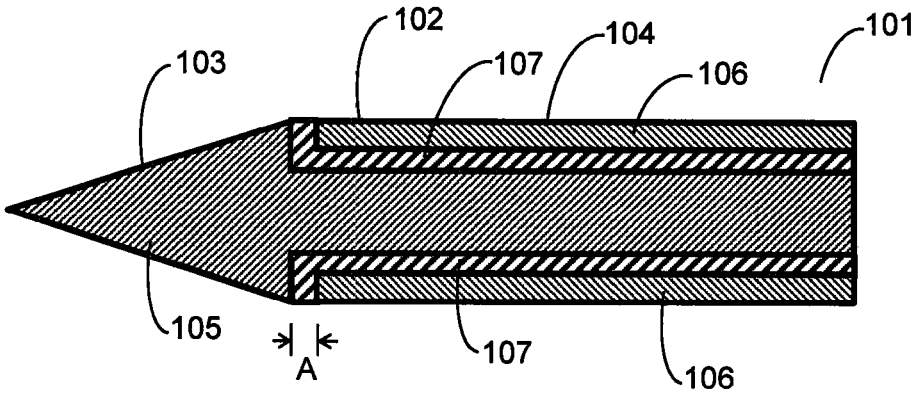
FIG. 1*a* shows a side elevation cross sectional illustration of a first embodiment of a projectile according to a first aspect of the invention.
Figure 1B:
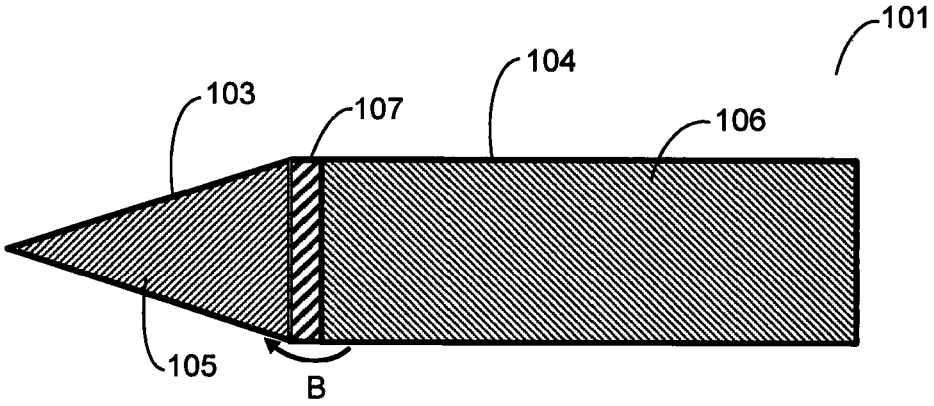
FIG. 1*b* shows a side elevation illustration of a first embodiment of a projectile according to a first aspect of the invention.

FIGS. 1*a* and 1*b* show an illustration of an embodiment of the first aspect of the invention. A projectile 101 is shown, having a projectile body 102 comprising a nose portion 103 and a tail portion (not shown). In this embodiment the projectile body is approximately 10 cm the length (along the longitudinal axis) and has a diameter of approximately 3 cm. A first electrode 105 extends the length of the projectile, with a first portion of the first electrode 105 forming the nose portion 103 and a second portion of the first electrode 105 extending internally along the length of the tail portion (not shown). The nose portion 104 is substantially conical in shape. A second electrode 106 is tubular in shape and is arranged coaxially about a portion of the length of the first electrode 105. The second electrode 106 forms the outer surface of the tail portion 104 of the projectile body 102. In this embodiment the first and second electrodes are formed from tungsten. An insulator 107 is arranged between the first electrode 105 and the second electrode 106 along the length of the tail portion 104. In this embodiment, the insulator 107 is a ceramic, for example, Boron Nitride or Cubic Zirconia, but insulator 107 could equally be another suitable insulating material, for example, a plastic, such as, PTFE or ABS. The first electrode and the second electrode are separated along the longitudinal axis by distance A, which in this embodiment is approximately 2 mm in distance. such that an electrical discharge can flow between the first electrode 105 and the second electrode 106, for example in the direction indicated by arrow B. The surface of the first electrode 105 and the second electrode 106 are arranged so as to be connectable to a source of electrical energy by welding.

Figure 2A:
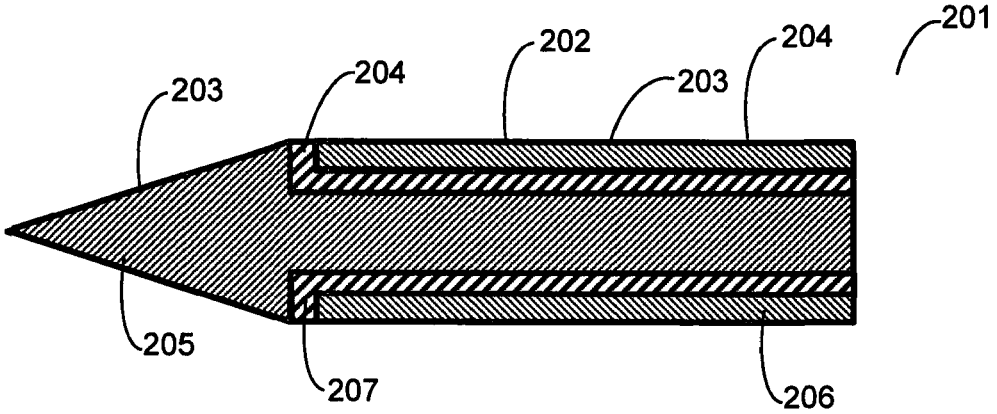
FIG. 2*a* shows a side elevation cross sectional illustration of a further embodiment of a mine disposal projectile according to a first aspect of the invention.
Figure 2B:
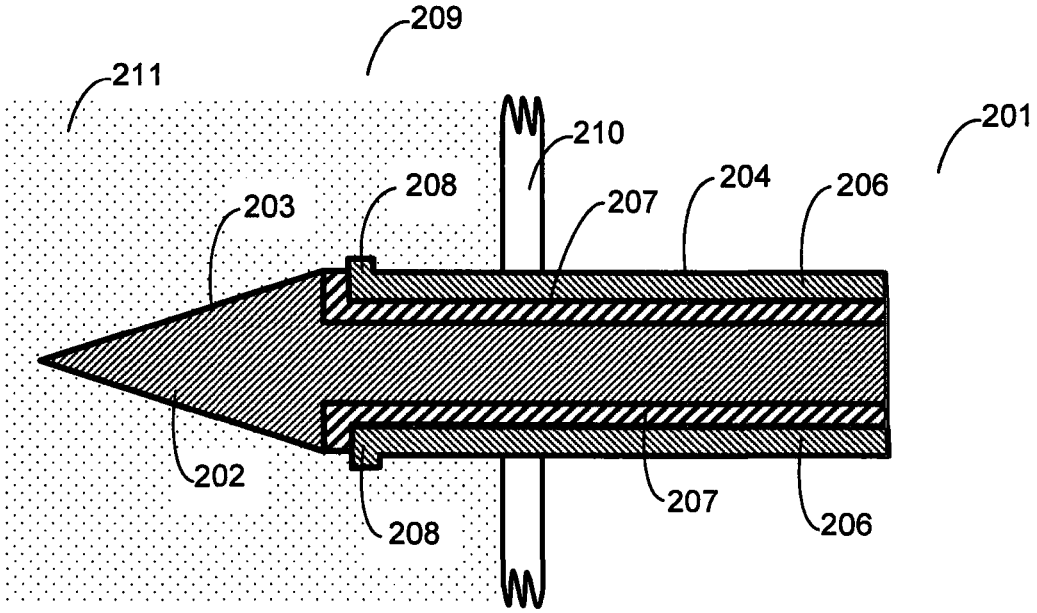
FIG. 2*b* shows a side elevation cross sectional illustration of a further embodiment of a projectile according to a first aspect of the invention when in use.

FIGS. 2*a* and 2*b* show an illustration of a different embodiment of the first aspect of the invention. A projectile 201 is shown, having a projectile body 202 comprising a nose portion 203 and a tail portion (not shown). A first electrode 205 extends the length of the projectile, with a first portion of the first electrode 205 forming the nose portion 203 and a second portion of the first electrode 205 extending internally along the length of the tail portion (not shown). The nose portion 204 is substantially conical in shape. A second electrode 206 is tubular in shape and is arranged coaxially about a portion of the length of the first electrode 205. The second electrode 206 forms the outer surface of the tail portion (not shown) of the projectile body 202. An insulator 207 is arranged between the first electrode 205 and the second electrode 206 along the length of the tail portion (not shown). The first electrode and the second electrode are separated along the longitudinal axis such that an electrical discharge (not shown) can flow between the first electrode 105 and the second electrode 106. In FIG. 2*b* the projectile 201 is shown partially embedded within the mine 209 (partially shown) having penetrated the mine casing 210 (partially shown). The second electrode 206 is deformable such that on penetration of the mine casing a portion of the second electrode 208 contacts the insulator 207 so as to deform the portion of the second electrode 208 away from the projectile body and into the explosive material 211. Therefore, the separation distance through which the electrical discharge can flow is increased. The surface of the first electrode 205 and the second electrode 206 are arranged so as to be connectable to a source of electrical energy by welding.

Figure 3A:
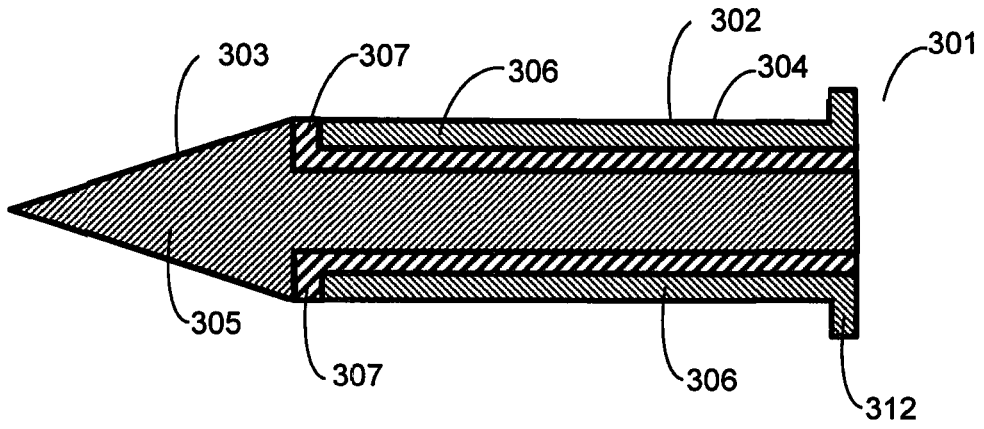
FIG. 3*a* shows a side elevation cross sectional illustration of a further embodiment of a projectile according to a first aspect of the invention.
Figure 3B:
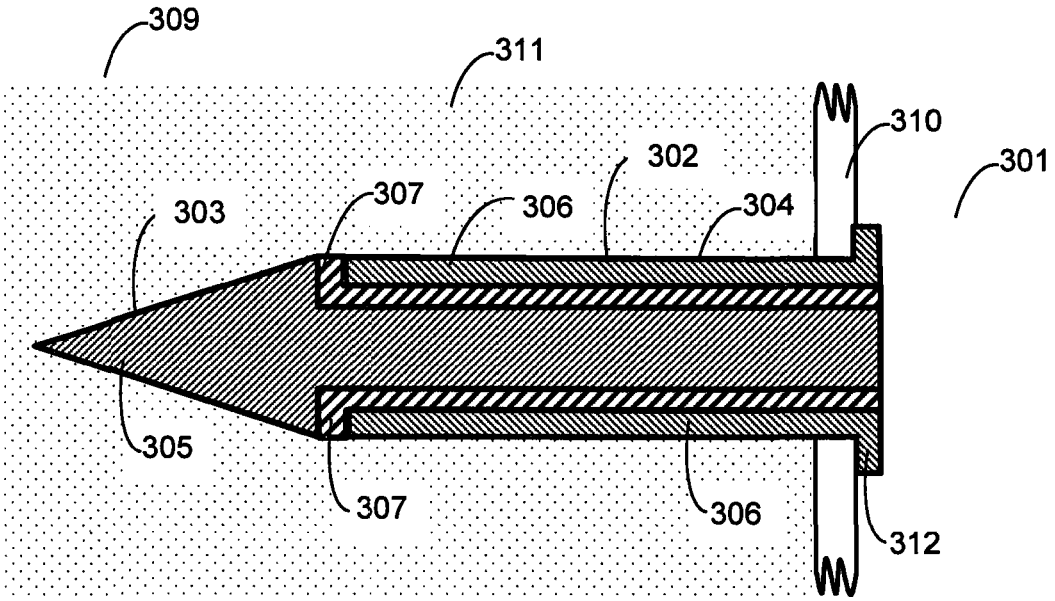
FIG. 3*b* shows a side elevation cross sectional illustration of a further embodiment of a projectile according to a first aspect of the invention when in use.

FIGS. 3*a* and 3*b* show an illustration of a further embodiment of the first aspect of the invention. A projectile 301 is shown, having a projectile body 302 comprising a nose portion 303 and a tail portion (not shown). A first electrode 305 extends the length of the projectile, with a first portion of the first electrode 305 forming the nose portion 303 and a second portion of the first electrode 305 extending internally along the length of the tail portion (not shown). The nose portion 304 is substantially conical in shape. A second electrode 306 is tubular in shape and is arranged coaxially about a portion of the length of the first electrode 305. The second electrode 306 forms the outer surface of the tail portion (not shown) of the projectile body 302. An insulator 307 is arranged between the first electrode 305 and the second electrode 306 along the length of the tail portion (not shown). The first electrode and the second electrode are separated along the longitudinal axis such that an electrical discharge (not shown) can flow between the first electrode 305 and the second electrode 306. The tail portion (not shown) has a flange 312 located at the opposing end from the nose portion 303. The flange 312 has a diameter greater than the rest of the projectile body 302. In FIG. 3*b*, the projectile 301 is shown partially embedded within the mine 309 (partially shown) having penetrated the mine casing 310 (partially shown). The flange 312 has controlled the degree of penetration of the projectile body 302 such that the nose portion 302 and a portion of the tail portion (not shown) have penetrated the mine casing 310 and are located internally to the mine 309. A portion of the tail portion (not shown) remains external to the mine. The surface of the first electrode 305 and the second electrode 306 are arranged so as to be connectable to a source of electrical energy by welding.

Figure 4A:
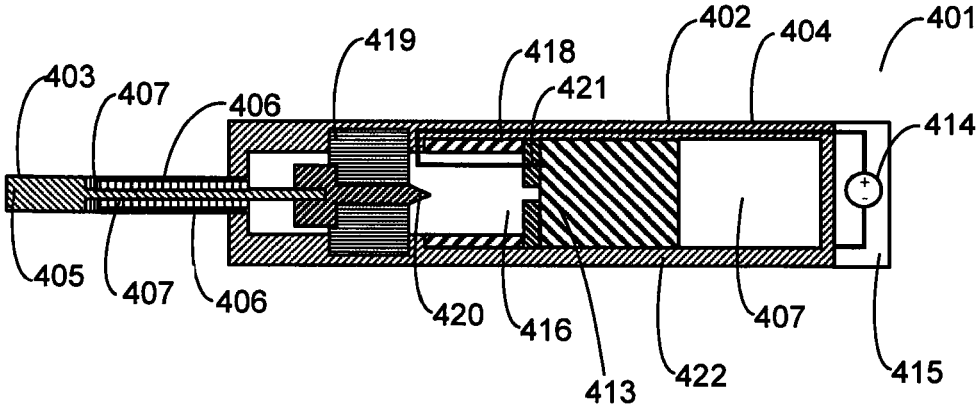
FIG. 4*a* shows a side elevation cross sectional illustration of a further embodiment of a projectile according to a first aspect of the invention.
Figure 4B:
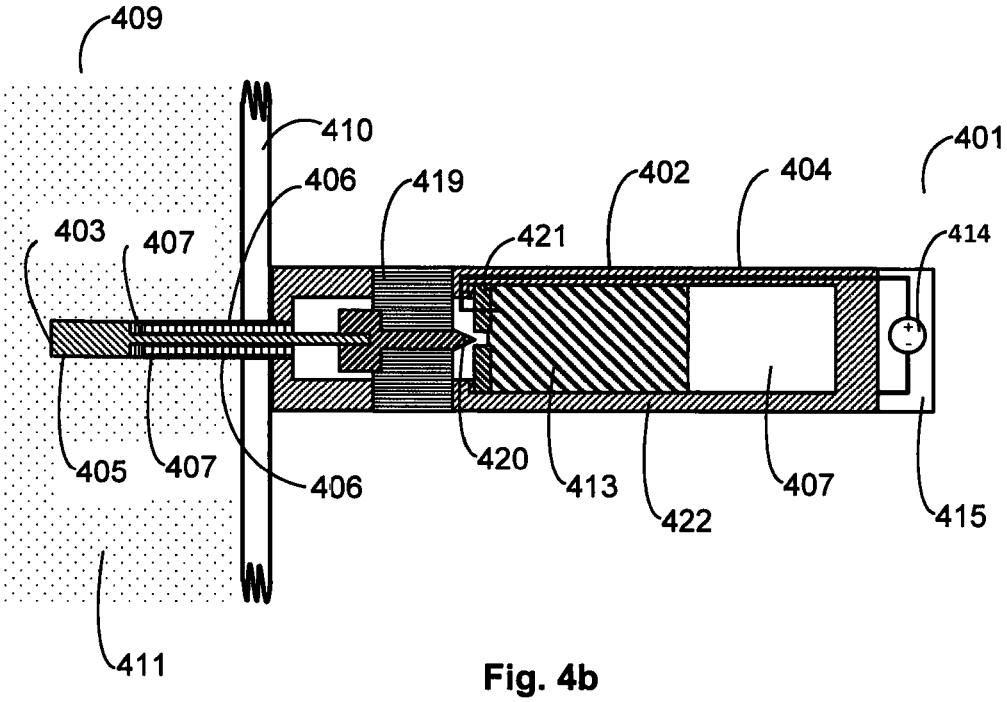
FIG. 4*b* shows a side elevation cross sectional illustration of a further embodiment of a projectile according to a first aspect of the invention when in use.

FIGS. 4*a* and 4*b* show an illustration of a further embodiment of the first aspect of the invention. A projectile 401 is shown, having a projectile body 402 comprising a nose portion 403 and a tail portion 404. A first electrode 405 extends from the tip of the nose portion 403 of the projectile body 402 internally along a portion of the length or the tail portion 404. The tip of the nose portion 404 is formed from a portion of the first electrode 405. The nose portion 404 is substantially cylindrical in shape. A second electrode 406, being tubular in shape, is arranged coaxially about a portion the first electrode 405. The second electrode 406 forms a portion of the outer surface of the nose portion 403 of the projectile body 402. An insulator 407 is arranged between the first electrode 405 and the second electrode 406 along a portion of length of the tail portion 404. The first electrode 405 and the second electrode 406 are separated along the longitudinal axis such that an electrical discharge (not shown) can flow between the first electrode 405 and the second electrode 406. The projectile 401 comprises and integral source of electrical energy, in the form of a capacitor 413. The capacitor 413 is charged using the integral battery 414 which is controlled by the integral battery control module 415. The capacitor is electrically connected to the second electrode 406 via the tail portion casing 418. The capacitor is arranged in the tail portion 404 between a first cavity 416 and a second cavity 417. The first and second cavities 416, 417 are filled with air. A compressible crumple ring 418 is located between the capacitor 409 and a keel 419. The keel 419 comprises a conductive switch element 420 to which the first electrode 405 is electrically connected. The capacitor is movable along the longitudinal axis of the tail portion 404 responsive to the penetration of the mine casing 410 by the projectile 401. Upon penetration of the mine casing 410 the capacitor 413 moves along the longitudinal axis towards the nose portion 403 by compressing the crumple ring 418. As the capacitor 413 moves towards the nose portion 403 the first cavity 416 becomes reduced in volume and the second cavity 417 becomes increased in volume. Air can pass from the first cavity 416 to the second cavity 417 through channels around the outer edge of the capacitor (not shown). During impact with the mine casing the air transfer between the first and second cavities 416, 417 produces a damping effect reducing the impact stress on the capacitor 413. The movement of the capacitor 413 towards the nose portion 403 closes the distance between the switch element 417 and the capacitor 413 enabling an electrical current to pass from the capacitor 413 to the switch element 417 and along the length of the first electrode 405 thereby electrically connecting the capacitor to the second electrode 406. As second electrode becomes electrically connected to the capacitor an electrical discharge flows between the first electrode 406 and the second electrode 407 through the explosive material 411.

The tail portion 404 has a diameter greater than the nose portion 403 of the projectile body 402. The tail portion 404 thereby acts as a retaining means controlling the degree of penetration of the projectile 401 into the mine 409. FIG. 4*b* shows the projectile 401 partially embedded within the mine 409 (partially shown) having penetrated the mine casing 410 (partially shown). The degree of penetration of the projectile body 402 in controlled such that the nose portion 402 has penetrated the mine casing 410 and is located internally to the mine 409 and the tail portion 404, being of greater diameter than the nose portion, 403 remains external to the mine 409.

Figure 5A:
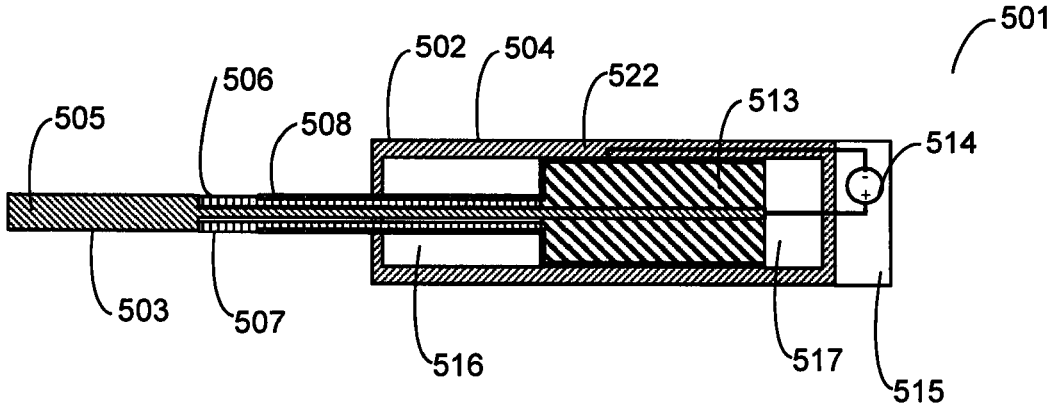
FIG. 5*a* shows a side elevation cross sectional illustration of a further embodiment of a projectile according to a first aspect of the invention.
Figure 5B:
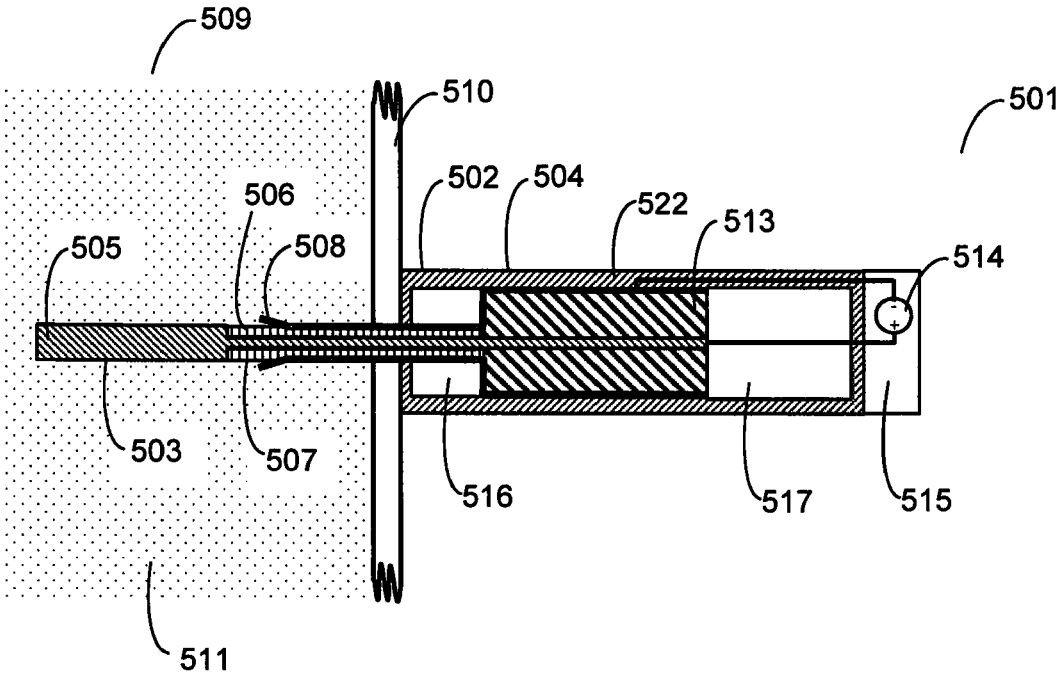
FIG. 5*b* shows a side elevation cross sectional illustration of a further embodiment of a projectile according to a first aspect of the invention when in use.

FIGS. 5*a* and 5*b* show an illustration of a further embodiment of the first aspect of the invention. A projectile 501 is shown, having a projectile body 502 comprising a nose portion 503 and a tail portion 504. A first electrode 505 extends from the tip of the nose portion 503 of the projectile body 502 internally along a portion of the length or the tail portion 504. The tip of the nose portion 504 is formed from a portion of the first electrode 505. The nose portion 504 is substantially cylindrical in shape. A second electrode 506, being tubular in shape, is arranged coaxially about a portion the first electrode 505. The second electrode 506 forms a portion of the outer surface of the nose portion 503 of the projectile body 502. The second electrode 506 extends internally along a portion of the length or the tail portion 504. An insulator 507 is arranged between the first electrode 505 and the second electrode 506 along a portion of the length of the nose and the tail portions 503, 504. The first electrode 505 and the second electrode 506 are separated along the longitudinal axis such that an electrical discharge (not shown) can flow between the first electrode 505 and the second electrode 506. The projectile 501 comprises and integral source of electrical energy, in the form of a capacitor 513. The capacitor 513 is charged using an integral battery 514 which is controlled by the integral battery control module 515. The first electrode 505 extends internally into the capacitor 513 and is thereby electrically connected to the capacitor. The second electrode 506 is partially arranged coaxially about the outer surface of the capacitor 515 and is thereby electrically connected to the capacitor. The capacitor is arranged in the tail portion 504 between a first cavity 516 and a second cavity 517 (which may form a combined cavity, or may be a pair of distinguishable differential pressure chambers). The first and second cavities 516, 517 may be filled with a compressible or incompressible medium (such as paraffin wax, silicone or air). The capacitor is movable along the longitudinal axis of the tail portion 504 responsive to the penetration of the mine casing 510 by the projectile 501. Upon penetration of the mine casing 510 the capacitor 513 moves along the longitudinal axis towards the nose portion 503 by compressing the wax located in the first cavity 516. During impact, heating of the projectile causes the wax to become at least partially molten. Holes (not shown) are provided in the tail portion casing 522 through which the wax located in the first cavity can flow and escape the mine projectile casing. The compression and evacuation of the wax from the first cavity 516 produces a damping effect reducing the impact stress on the capacitor 513 and any associated electronics.

The second electrode 506 is deformable such that on penetration of the mine casing, as the capacitor 513 moves towards the nose portion 503, a portion of the second electrode 508 contacts the insulator 507 deforming the portion of the second electrode 508 away from the projectile body 502 and into the explosive material 511. Therefore, the electrodes form an electrical current path through the explosive material.

The tail portion 504 has a diameter greater than the nose portion 503 of the projectile body 502. The tail portion 504 thereby acts as a retaining means controlling the degree of penetration of the projectile 501 into the mine 509. FIG. 5*b* shows the projectile 501 partially embedded within the mine 509 (partially shown) having penetrated the mine casing 510 (partially shown). The degree of penetration of the projectile body 502 is controlled such that the nose portion 502 has penetrated the mine casing 510 and is located internally to the mine 509 and the tail portion 504, being of greater diameter than the nose portion, 503 remains external to the mine 509.

Figure 6A:
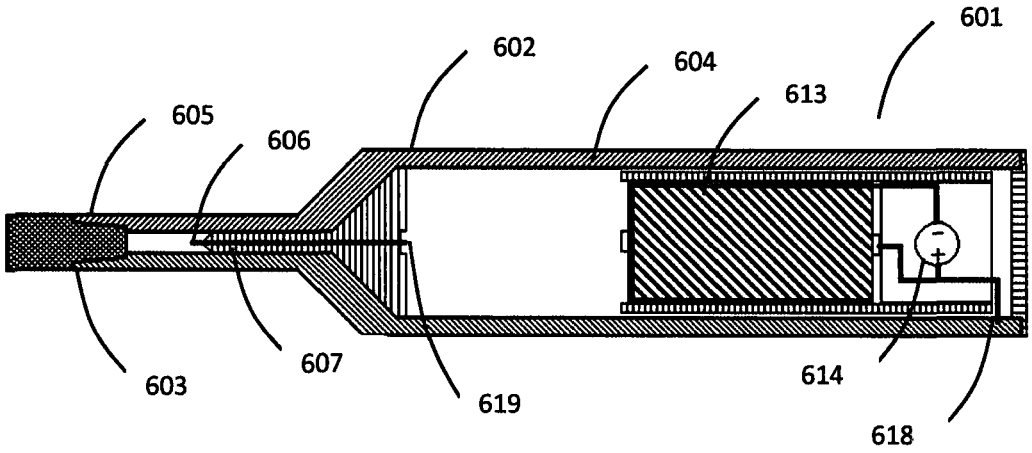
FIG. 6*a* shows a side elevation cross sectional illustration of a further embodiment of a projectile according to a first aspect of the invention.
Figure 6B:
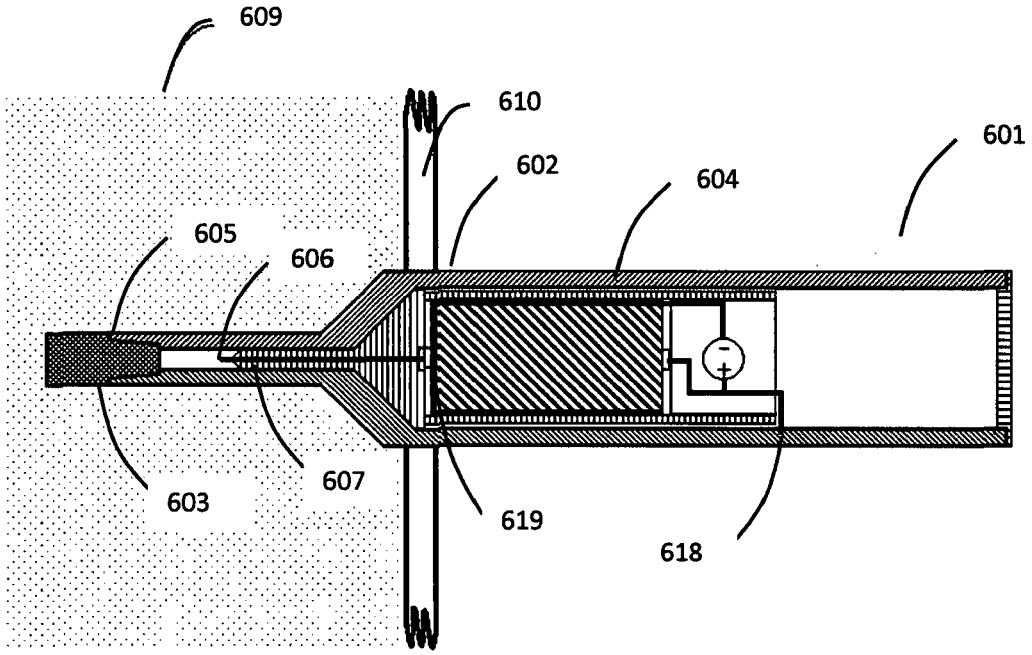
FIG. 6*b* shows a side elevation cross sectional illustration of a further embodiment of a projectile according to a first aspect of the invention when in use.

FIGS. 6*a* and 6*b* show an illustration of a further embodiment of the first aspect of the invention. A projectile 601 is shown, having a projectile body 602 comprising a nose portion 603 and a tail portion 604. Except where stated like parts in FIGS. 6*a* and 6*b* match those in the embodiment shown in FIGS. 5*a* and 6*b*.

First electrode 605 and second electrode 606 extend forward through the nose portion 603. In this embodiment an outer wall of the nose portion (or in this case also of the projectile body) forms the second electrodes 606. A conduction path is established (in event that there is a dielectric surrounding the nose portion) between the pointed tip of second electrode 606 and the circular tip of first electrode 605, but otherwise are separated by an insulator 607. The first electrode 605 and the second electrode 606 are separated along the longitudinal axis such that an electrical discharge (not shown) can flow between the first electrode 605 and the second electrode 606.

The projectile 601 comprises and integral source of electrical energy, in the form of a capacitor 613. The capacitor 613 is charged using an integral battery 614 which is controlled by an integral battery control module (not shown). The first electrode 605 is connected to the capacitor 613 by a sliding electrical connection 618, and is thereby electrically connected to the capacitor. The second electrode 606 is connected to the capacitor only in the event that the capacitor slides within a cavity within the tail portion 604 forwards to connect to pressure/touch or sliding electrical connector 619.

The cavity may be filled with a compressible or incompressible medium (such as paraffin wax, silicone or air) so long as this does not prevent electricity flowing across the two connectors 618 and 619. The capacitor is movable along the longitudinal axis of the tail portion 604 responsive to the penetration of the mine casing 610 by the projectile 601. Upon penetration of the mine casing 610 the capacitor 613 moves along the longitudinal axis towards the nose portion 603 (e.g. by compressing/displacing the substance/wax) located in the cavity. If a wax or wax-like substance is used then during impact, heating/heating/shear forces caused by the projectile causes the wax (or other substance) to become at least partially molten. Holes (not shown) are provided in the tail portion casing 622 through which the wax located in the cavity can flow and escape the mine projectile casing. The compression and evacuation of the wax from the cavity produces a damping effect reducing the impact stress on the capacitor 613 and any associated circuitry/electronics that may slide along with it.

The tail portion 604 has a diameter greater than the nose portion 603 of the projectile body 602. The tail portion 604 thereby acts as a retaining means controlling the degree of penetration of the projectile 601 into the mine 609. FIG. 6*b* shows the projectile 601 partially embedded within the mine 609 (partially shown) having penetrated the mine casing 610 (partially shown). The degree of penetration of the projectile body 602 is controlled such that the nose portion 602 has penetrated the mine casing 610 and is located internally to the mine 609 and the tail portion 604, being of greater diameter than the nose portion, 603 remains external to the mine 609.

The nose portion 603 shows a space in front of the central electrode, behind the penetrating tip (which in any embodiment could be a dense and hard penetrating material such as tungsten). In the case that the first electrode is cylindrical around the second electrode then this is a cavity which could filled with the aforementioned energetic material. Alternatively if the first electrode is not cylindrical, but rather perhaps in the form of two rods either side of the second electrode, then the space will become filled with the explosive within the mine. In the case that another material such as salt water is used, this may be introduced between the electrodes during use, either by the user or by immersing the projectile into the material (water, typically salt water). In this case the nose portion has an ingress path (not shown) to allow the material to ingress between the electrodes.

Note that the term 'between' relates to the path that an electrical discharge would take between the two electrodes—if there is an insulator in the way of a straight line electrical discharge, then the discharge path will instead go around the insulator and this path should be considered to be between the electrodes irrespective of it not being a straight path.

Figure 7:
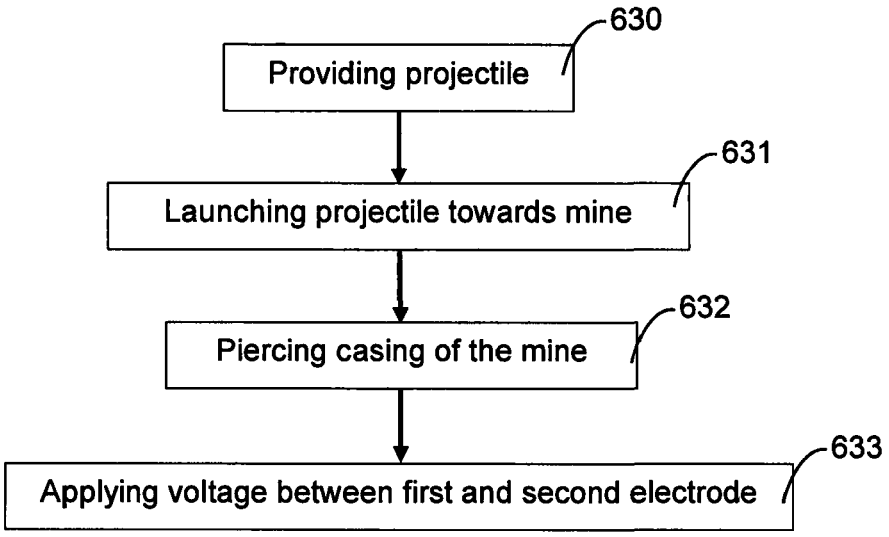
FIG. 7 shows a flow diagram illustrating a method according to a second aspect of the invention.

FIG. 7 shows an illustration of a further embodiment of the first aspect of the invention. A projectile is provided according to a first aspect of the invention (630) as illustrated in the embodiment of FIGS. 2*a* and 2*b*. The projectile is launched from a launch tube towards a mine (631). The casing of the mine is pierced by the projectile (632) such that the projectile is partially embedded within the mine as shown in the embodiment of FIG. 2*a*. A voltage is applied between the first electrode and the second electrode of the projectile wherein the voltage is of sufficient magnitude to so as to cause an electrical discharge to flow between the first electrode and the second electrode through the explosive material of the mine so as to initiate an explosive reaction. (633).

The invention claimed is:

1. A projectile for piercing a casing of a mine containing an explosive material;

the projectile comprising a projectile body having a nose portion and a tail portion wherein a longitudinal axis extends between the nose portion and the tail portion, the projectile body comprising a switch, a first electrode, and a second electrode;

wherein the switch is configured to control a closure of a circuit connecting the first electrode and the second electrode to a source of electrical energy; and wherein the first electrode and the second electrode are separated by a separation distance such that in use an electrical discharge can flow between the first electrode and the second electrode, either through an explosive material contained within a mine, or through a material comprised between the electrodes or which is introduced between the electrodes in use, so as to cause the material to release energy so as to detonate an explosive material contained within a mine.

2. The projectile of claim 1 wherein the first electrode and the second electrode are separated by a separation distance such that in use an electrical discharge can flow between the first electrode and the second electrode through an explosive material contained within a mine.

3. The projectile of claim 1 comprising an energetic material comprised between the electrodes, wherein the first electrode and the second electrode are separated by a separation distance such that in use an electrical discharge can flow between the first electrode and the second electrode to initiate the material comprised between the electrodes.

4. The projectile of claim 3 wherein the nose portion is provided with a water ingress path arranged such that in use underwater, and wherein water can ingress to a location between the first and second electrodes, such that in use an electrical discharge can flow between the first electrode and the second electrode, through the water between the electrodes, to initiate the energetic material, to detonate an explosive material contained within a mine.

5. The projectile of claim 1 wherein the nose portion comprises whole or part of one or both of the first electrode and the second electrode.

6. The projectile of claim 1 wherein the first electrode and the second electrode are coaxially arranged about the longitudinal axis.

7. The projectile of claim 1 wherein the first electrode and the second electrode are separated along the longitudinal axis of the projectile by the separation distance.

8. The projectile of claim 1 wherein the nose portion comprises a detachable casing.

9. The projectile of claim 8 wherein the detachable casing is arranged to be detachable responsive to an impact between the projectile and a mine casing.

10. The projectile of claim 1 further comprising a retaining means for retaining the projectile partially within the casing of a mine.

11. The projectile of claim 10 wherein the retaining means comprises a flange projecting from the projectile body.

12. The projectile of claim 1, wherein the switch comprises a sensor configured to sense the piercing of a mine casing by the projectile.

13. The projectile of claim 12 wherein the switch comprises a first switch element and a second switch element, wherein the first switch element and the second switch element are separated along the longitudinal axis by a switch distance, and wherein the switch is compressible along the longitudinal axis such that in use impact of the projectile body with a mine casing causes relative movement between the first switch element and the second switch element such that the switch distance is reduced causing the switch to be triggered.

14. The projectile of claim 1 wherein the projectile further comprises a source of electrical energy.

15. The projectile of claim 14 wherein the source of electrical energy is integral to the projectile body.

16. The projectile of claim 15 wherein the source of electrical energy comprises a piezoelectric material.

17. The projectile of claim 15 wherein the source of electrical energy comprises a capacitor.

18. The projectile of claim 15 wherein energy source is arranged to supply between 1,000 to 30,000 volts per mm across the separation distance between the electrodes.

19. The projectile of claim 1 wherein the separation distance between the electrodes is in a range of 0.1 mm to 5 mm.

20. The projectile of claim 1, wherein the tail portion has a larger cross section than the nose portion with respect to the longitudinal axis, being at least double that of the nose portion.

21. A method of mine disposal, the method comprising the steps of:

i. providing a projectile according to claim 1;

ii. launching the projectile towards a mine;

iii. piercing the casing of the mine with the projectile; and iv. applying a voltage between the first electrode and the second electrode of the projectile so as to cause an electrical discharge to flow between the first electrode and the second electrode either through an explosive material contained within a mine, or through a material comprised between the electrodes or which is introduced between the electrodes in use, so as to cause the material to release energy so as to detonate an explosive material contained within a mine.

* * * * *